US005616007A

United States Patent [19]

Cohen

[11] Patent Number: 5,616,007

[45] Date of Patent: Apr. 1, 1997

[54] LIQUID SPRAY COMPRESSOR

[76] Inventor: Eric L. Cohen, 5 Thousand Oaks Ter., Howell, N.J. 07731

[21] Appl. No.: 587,488

[22] Filed: Jan. 17, 1996

Related U.S. Application Data

[63] Continuation-in-part of Ser. No. 360,424, Dec. 21, 1994, abandoned.

[51] Int. Cl.[6] ..... F04F 11/00

[52] U.S. Cl. ..... 417/65; 417/92

[58] Field of Search ..... 417/65, 92

[56] References Cited

U.S. PATENT DOCUMENTS

| | | | |
|---|---|---|---|
| 586,100 | 7/1897 | Knight | 417/92 |
| 652,559 | 6/1900 | Hobby | 417/92 |

FOREIGN PATENT DOCUMENTS

| | | | |
|---|---|---|---|
| 43105 | 4/1977 | Japan | 417/92 |
| 779623 | 11/1980 | U.S.S.R. | 417/65 |
| 2735 | 6/1882 | United Kingdom | 417/92 |
| 2148399 | 5/1985 | United Kingdom | 417/65 |

*Primary Examiner*—Timothy Thorpe
*Assistant Examiner*—Roland G. McAndrews, Jr.
*Attorney, Agent, or Firm*—Hoffman, Wasson & Gitler

[57] ABSTRACT

A liquid spray compressor is provided in which cooling liquid is sprayed into a vessel containing gases or vapors to be compressed, thereby displacing the gas and simultaneously absorbing a significant amount of the heat of compression.

1 Claim, 8 Drawing Sheets

LIQUID SPRAY COMPRESSOR

This application is a continuation-in-part of copending application application Ser. No. 08/360,424 filed on Dec. 21, 1994, now abandoned.

BACKGROUND OF THE INVENTION

1. Field of the Invention

The present invention relates to liquid spray compressors. More particularly, the present invention relates to a liquid spray compressor in which cooling liquid is sprayed into a vessel containing gasses or vapors to be compressed, thereby displacing the gas and simultaneously absorbing a significant amount of the heat of compression.

2. Description of the Prior Art

Compressors with liquid injection for cooling or sealing are well known. For example, U.S. Pat. No. 2,025,142 (Zahn et al) shows a cooling system for a gas compressor in which a spray of cold water is injected into the compressor to cool the gas during compression. The device employs a positive displacement device to compress the gas. Consequently, it requires precision machined pistons and cylinders, which require significant manufacturing time, skill and expense to create. Furthermore, the packing is a source of leakage and friction.

U.S. Pat. No. 2,042,991 (Harris, Jr.) discloses a method and apparatus for producing vapor saturation in which liquid is injected into a compressor during the compression stroke. The apparatus relies on a precision machined piston and cylinder to displace the vapor. The presence of the sprayed liquids in this machine causes problems. In particular, the sprayed liquid can wash away lubricants or oils. Additionally, during the cycle, all of the volume of the cylinder may become filled with liquid. If a discharge valve is closed or if a discharge line is blocked while the piston is displacing the volume, "Hydraulic lock" will occur. Extremely high pressure will result, causing catastrophic failure of the apparatus. The device also wastes energy by spraying the liquid at high pressure.

A compressor utilizing water as a spray into the compression cylinder to cool air that is being compressed to thereby absorb heat is shown in U.S. Pat. No. 2,404,660 (Rouleau), and suffers from the same drawbacks as the Harris and Zahn et al devices.

Rouleau also teaches a gas compressor in U.S. Pat. No. 2,420,098 where some of the compressed gas is used to force a cooling spray into a piston and cylinder compressor. Due to the design of the Rouleau compressor, a volume of gas equal to the volume of cooling liquid is wasted, thereby negating much if not all of the thermodynamic benefit of cooling during compression.

Another compressor is disclosed in U.S. Pat. No. 3,105,630 (Lowler) in which oil or other liquid is injected into the compression chambers of the compressor for cooling, lubricating and sealing purposes. While the Lowler design provides some benefit of direct contact between the cooling liquid and the gas undergoing compression, and avoids "Hydraulic lock," it still requires precision positive displacement elements and considerable manufacturing costs, as well as achieving less than optimum cooling.

U.S. Pat. No. 3,482,768 (Cirrincione) and U.S. Pat. No. 4,273,514 (Shore) illustrate common system for coolant flow to a rotary positive displacement compressor. As such they suffer from the same drawbacks discussed previously, specifically, the need for positive displacement elements which must be manufactured to precise tolerances, requiring considerable manufacturing time and thereby being costly to make.

SUMMARY OF THE INVENTION

These and other deficiencies of the prior art are addressed by the present invention which is directed to a liquid spray compressor in which cooling liquid is sprayed into a vessel containing gas or vapor to be compressed, thereby displacing the gas and Simultaneously absorbing a significant amount of the heat of compression. The apparatus achieves high energy efficiency due to the continuous intercooling effect of the liquid spray. Due to its mechanical simplicity, intercooling heat exchangers are eliminated, as are precision mechanical elements for the displacement of gases. In addition the need for lubricants is eliminated. Resulting contamination in the compressed gas is thereby eliminated, the system is simpler and less costly to manufacture.

The spray of liquid into the compression chamber is configured to promote heat transfer by making droplets of the liquid small, and directing the droplets to achieve maximum contact with the gas while minimizing the pressure energy dissipated through the diffuser. The chamber may also be equipped with baffles or packing to promote liquid to gas contact as is well known in cooling towers and strippers.

Based on the foregoing, it is an object of the present invention to provide a liquid spray compressor which uses less energy to perform a given amount of compression work than conventional compressors.

Another object of the present invention is to provide a liquid spray compressor which is mechanically simpler than previous positive displacement compressors.

Still another object of the present invention is to provide a liquid spray compressor which eliminates the need for compression chamber lubrication, thereby eliminating the problem of contamination of the compressed gas with the lubricant.

Yet another object of the present invention is to provide a liquid spray compressor which achieves high energy efficiency due to the continuous intercooling effect of the liquid spray.

Another object of the present invention is to provide a liquid spray compressor in which the spray of liquid into the compression chamber is configured to promote heat transfer by making droplets of the liquid small, and directing the droplets to achieve maximum contact with the gas while minimizing the pressure energy dissipated through the diffuser.

BRIEF DESCRIPTION OF THE DRAWINGS

These and other attributes of the present invention will be described with respect to the following drawings in which.

DETAILED DESCRIPTION OF THE INVENTION

Figure 1:
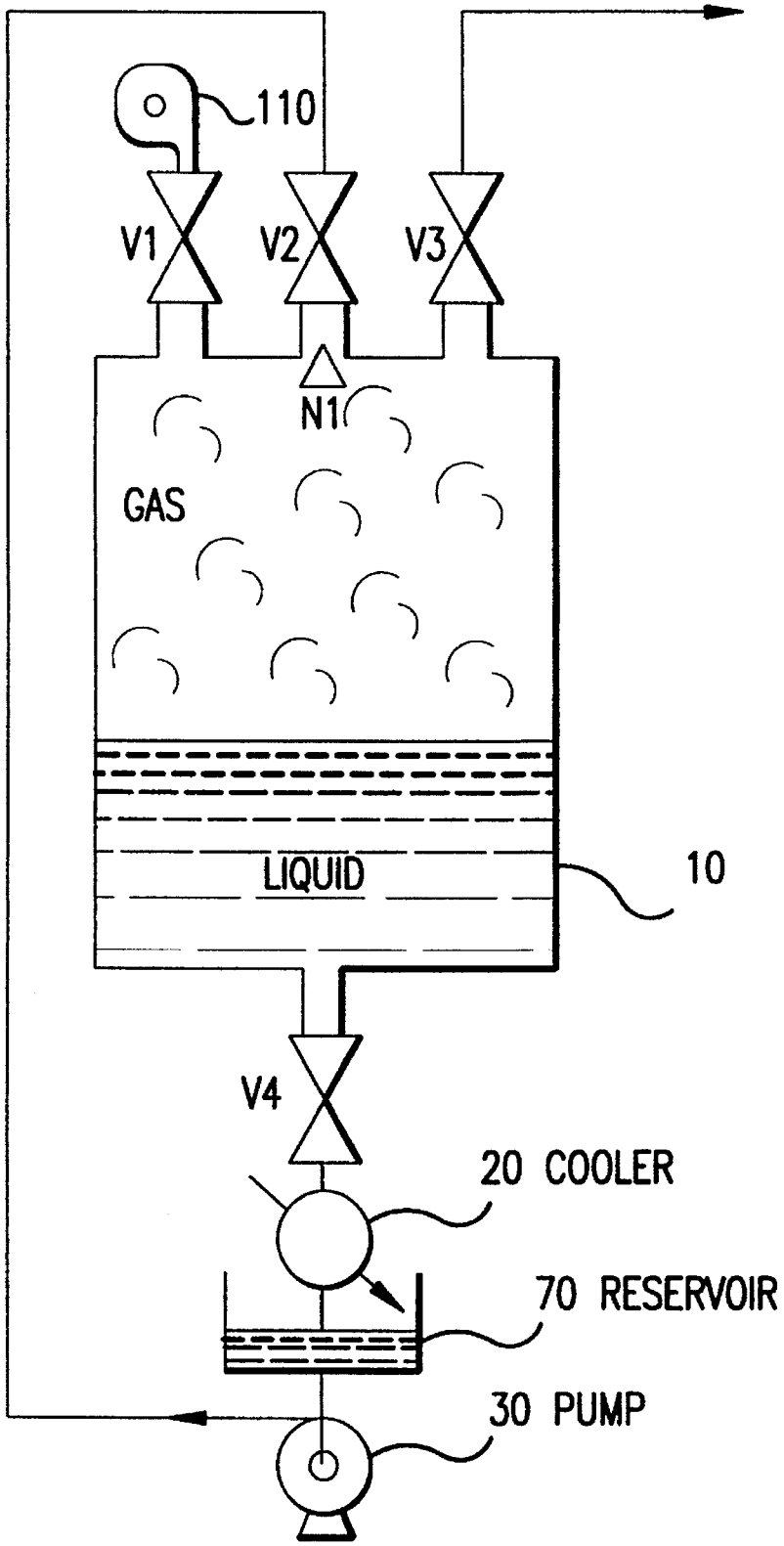
FIG. 1 is a schematic view of a liquid spray compressor according to the present invention.

Referring to FIG. 1, a general schematic view of an embodiment of the present invention is illustrated. A compression vessel 10 is provided, its volume to be filled alternately with gas or vapor, preferably air, and liquid, preferably water. Connected to the vessel are four nozzles with valves: V1, V2, V3, and V4. Valve V1 in an open position allows low pressure air or other gas to enter the vessel during the recharge procedure. The valve V1, in a closed position, keeps the vessel contents from escaping during the compression process, Valve V2, in an open position allows a stream of cool liquid into the vessel during the compression process. Valve V2 is closed during recharge to prevent waste of cooling liquid and pump energy. Valve v3, when open, allows the compressed gas to flow to the point of use. When closed valve V3 prevents backflow into the compression vessel. Valve V4, when closed during compression, retains the liquid in the vessel. During recharge, V4 is open, and the liquid flows out of the vessel to the cooler 20 and reservoir.

Most applications where the liquid is recirculated will require a liquid reservoir. Depending on the application, the reservoir may be before, after, or coincident with the cooler.

A pump, 30 is shown, taking suction from the reservoir and or cooler and discharging to valve V2. If a source of cooling liquid at adequate pressure is available, a pump is not required.

The operational cycle consists of a compression process and a drain/recharge procedure. At the beginning of the compression process, the vessel 10 is full of gas at its low, feed pressure. Valves V1, V3, and V4 are closed. A stream of cooling liquid is pumped into the vessel 10 through open valve, V2. Nozzle N1 disperses the stream into droplets. A system of nozzles and baffles is provided, similar to those used in cooling towers to maximize the heat transfer between the liquid and the gas, utilizing a minimum of liquid feed pressure energy. As the liquid flows into the vessel 10, the gas is displaced and compressed. The pressure of the gas increases. The heat compression is substantially absorbed by the liquid. At a point during the compression, suitable to the application, valve V3 opens, allowing compressed gas to flow to the point of use. Valve V3 may be a check valve, a float valve, an actuated valve or combination thereof. A demister or separator may be used to remove entrained cooling liquid from the gas stream as is commonly found on compression systems.

When most of the compressed gas has left the vessel, and before an excessive amount of liquid is carried out through valve V3, all of the valves change position. Valves V2 and V3 close, and valves V1 and V4 open. The flow of liquid into the vessel is stopped by the closing of valve V2. Backflow of compressed gas is prevented by valve V3 being closed. Open valves V1 and V4 allow a fresh supply of uncompressed gas to enter through valve V1 while the liquid drains through valve V4. Low flow restriction of valves V1 and V4 is preferred to minimize recharge time. Valve V1 may be a check valve or an actuated valve.

After the liquid passes through liquid drain valve V4, it flows through a cooler 20, where it is cooled. An external source of cooling liquid may be used. In this case a cooler is not required. A pump may or may not be required, depending on the pressure of the water source.

The valves V1, V2 and V4 can be effectively controlled based upon the liquid level in the vessel 10. Alternatively, the timing of the opening and closing of the valves V1, V2 and V4 could be controlled in an equally effective fashion based upon the known flow rate of the liquid.

If the gas to be compressed is atmospheric air, some of its inherent moisture will condense during compression. The compatibility of the water from the atmospheric air and the liquid used in the compressor, as well as the compressor materials, must be considered in the design. Such condensation of water is one reason water is the preferred liquid in the compression vessel 10. A highly efficient compressor is achieved when water is employed as the compressing liquid and an atmospheric cooling tower is used as the cooler 20, as shown in FIG. 2.

Alternative filling of more than one compression vessel could be used so as to smooth out the liquid pump load and the flow of compressed gas. Improved pump efficiency and utilization can be achieved by using different pumps, selected for different discharge pressure ranges, during the varying pressures of compression experienced during each compression stroke. However, such an arrangement would complicate the need for multiple vessels to smooth out loads for more than one pump.

As a minor variation, a simplified cycle could be achieved by maintaining the valve V2 in an open state, with only a minor loss of efficiency.

Figure 2:
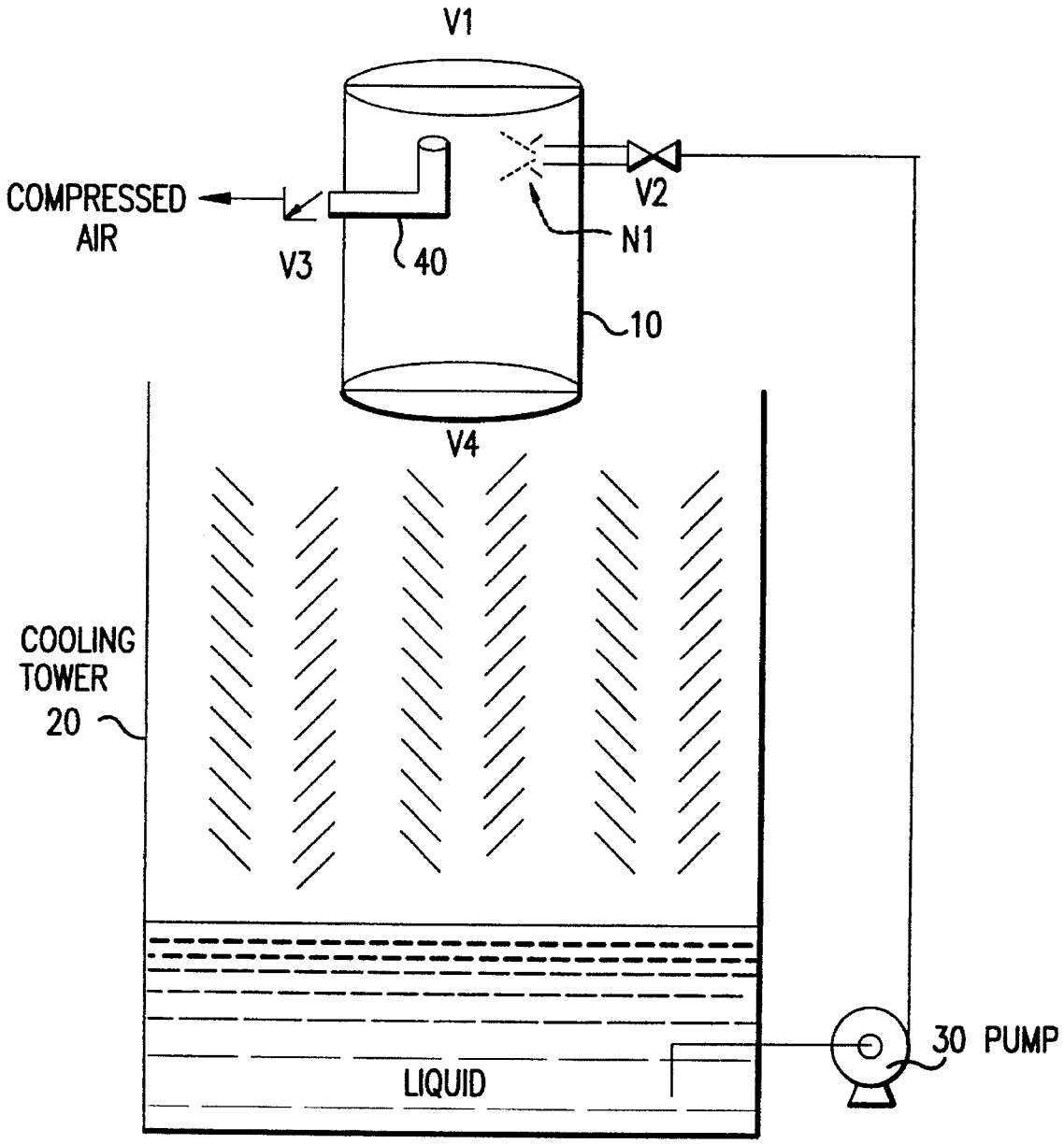
FIG. 2 is a schematic view of an advantageous arrangement of a liquid spray compressor according to the present invention.

FIG. 2 illustrates an advantageous arrangement of the liquid spray-compressor of FIG. 1. In such an arrangement the valves V1 and V4 are butterfly valves, or other such valves that operate quickly and have low flow restriction. As stated previously, the valve V2 could be left open with only a minor loss in efficiency, thereby making it optional. The liquid is water and the cooler 20 is a cooling tower. The valve V2 is connected to the compression vessel 10 near its upper edge and creates a water spray in the compression vessel 10. The compressed air valve V3 is located at the end of a passage which has its opposing end connected near the top of the compression vessel 10. In the arrangement illustrated in FIG. 2, the passage 40 is L-shaped.

The several configurations of the compressor lend themselves to a variety of new combustion engine configurations. heat can be added to the gas after compression within the chamber. As a result, high pressure, high temperature gas is produced above the liquid. Some of the liquid may boil, thereby adding to the vapor phase. Energy can be drawn off by expanding the gas phase through a turbine or a positive displacement expansion device, or by running the liquid through a hydraulic motor.

The liquid spray compressor can be used to provide compressed air to a modified Brayton Cycle. The compressed air after leaving the compression vessel 10 will have fuel added and burned in a combustion chamber and expansion will be through a turbine.

A variation of the foregoing arrangement is to heat clean compressed air before expansion in a turbine, using an air-to-air heat exchanger. The hot exhaust of clean air from the turbine can then be used for combustion air. The combustion products run through the other side of the heat exchanger to heat the clean air. As a result, higher flame temperature is achieved, creating higher efficiency. Combustion at atmospheric pressure allows flexibility in the choice of fuels, and makes the combustion chamber cheaper and simpler. Finally the air going through the turbine is cleaner.

Figure 3:
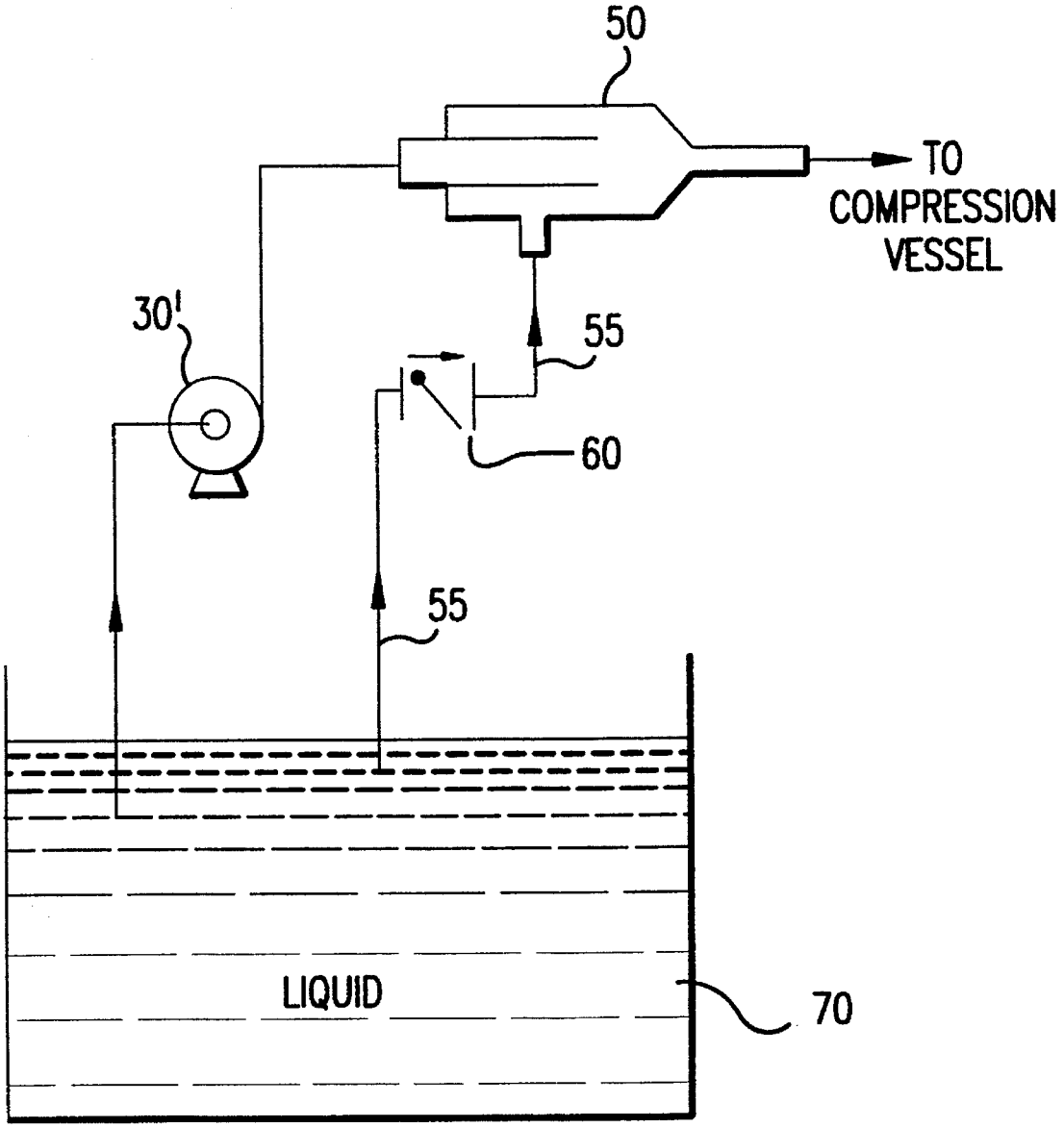
FIG. 3 is a schematic view of an alternate arrangement for making more advantageous use of a centrifugal pump, or other source of pressurized liquid, to feed liquid to a liquid spray compressor according to the present invention. A jet pump is used at the beginning of the compression operation to multiply the pump flow rate.

Referring to FIG. 3, an alternative feed water arrangement to a liquid spray compressor according to the present invention is illustrated. A motor driven pump 30 which produces a shut off head pressure slightly higher than the desired compressed gas pressure is shown. At the beginning of the compression cycle, the back pressure from the compression vessel 10 is low. The pump 30 runs out on its curve, resulting in a high flow rate, which induces flow through the jet pump 50. As a result the vessel 10 would fill faster, and would require less energy. As the vessel 10 fills, the back pressure increases, and the jet pump 50 stops adding to the discharge rate. A check valve 60 in the jet pump suction line 55 would prevent backflow to the reservoir 70.

To reduce the time taken by the drain/recharge operation, a variety of methods are suggested:

—Trapping a small amount of compressed gas in the vessel to accelerate the liquid out of drain valve V4.

—Storing mechanical energy in springs or other such elastic elements, releasing the same to accelerate the liquid out of drain valve V4.

—Boosting the pressure and velocity of the feed gas with a mechanical fan;

—Boosting the velocity of the feed gas, by use of an air amplifier, using a small stream of the compressed gas; and —Accelarating the vessel 10 so centrifical force propels the liquid out the drain valve V4.

Figure 4:
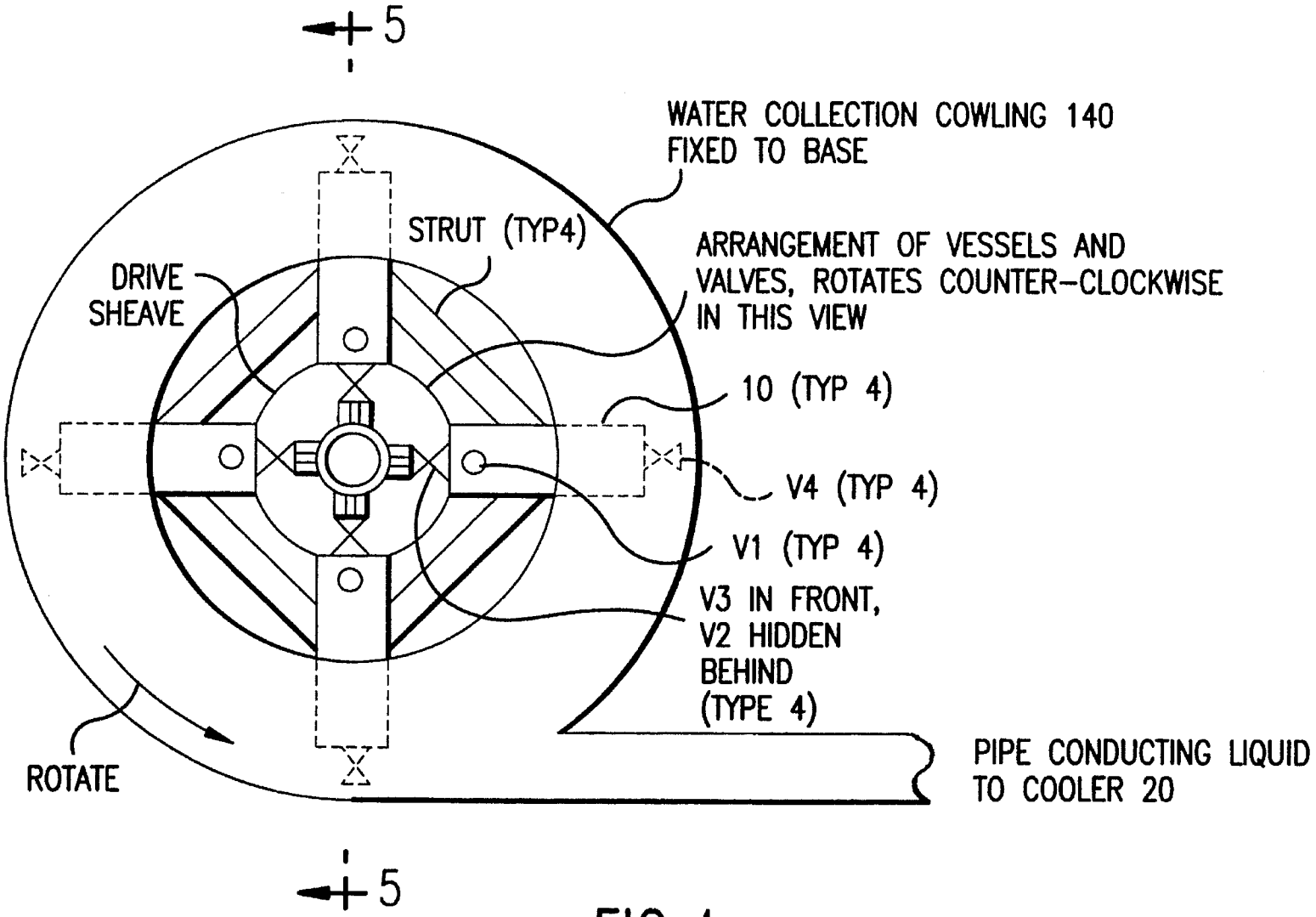
FIG. 4 is a configuration of the valves according to a preferred embodiment of the present invention in which the vessel is accelerated so the centrifugal force propels liquids out the drain valve.
Figure 5:
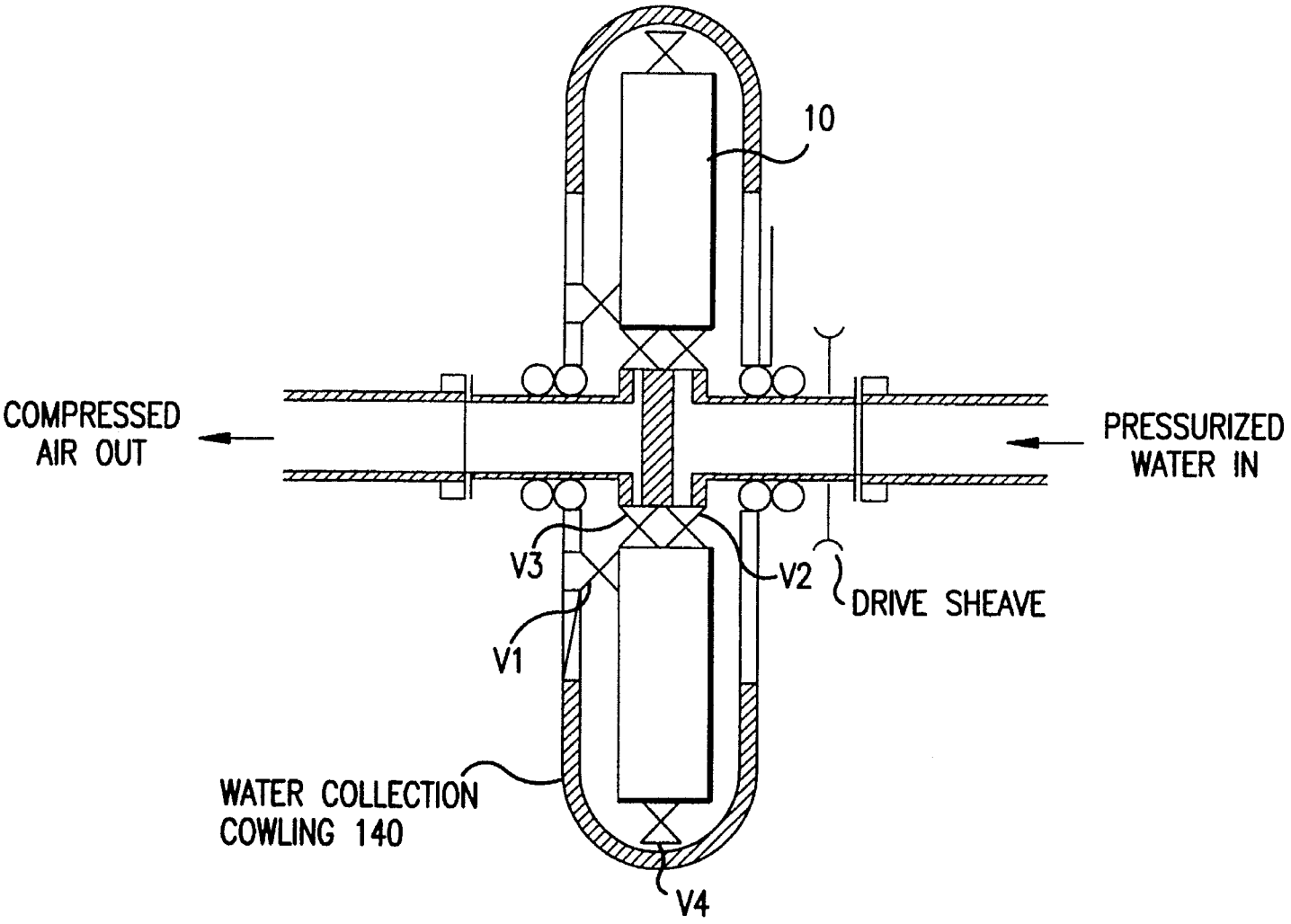
FIG. 5 is a view taken along the line 5—5 shown in FIG. 4.

Referring to FIGS. 4 and 5, one or several of the compression chambers shall be arranged to rotate about an axis. The power enforced to create the rotation is provided by an outside device through power-transmission equipment. The rotation or velocity generates centrifugal force in the liquid. The centrifugal force causes the liquid to drain quickly when valve V4 is opened. This improvement greatly decreases the time required for each cycle. The flow capacity of a given compression chamber is greatly increased, rendering the compressor more practical.

FIG. 4 shows the preferred embodiment of the present invention in which the vessel is accelerated so the centrifugal force propels the liquid out the drain valve. A water collection cowling 140 is provided fixed to a base. The valves V3 and V2 as well as the vessels rotate counterclockwise as shown in FIG. 5. The cowling 140 is connected to a pipe which conducts liquid to the cooler 20. Water collection cowling 140 can also be seen in FIG. 5.

Referring back to FIG. 1, a mechanical fan 110 can be connected so that it discharges into valve V1. During the drain and recharge process, the fan 110 would impart greater velocity and pressure to the air entering vessel 10 through the valve V1. The drain of liquid is hastened, and the charge of gas to be compressed is of higher initial density. The power for the fan 110 is externally provided.

Figure 6:
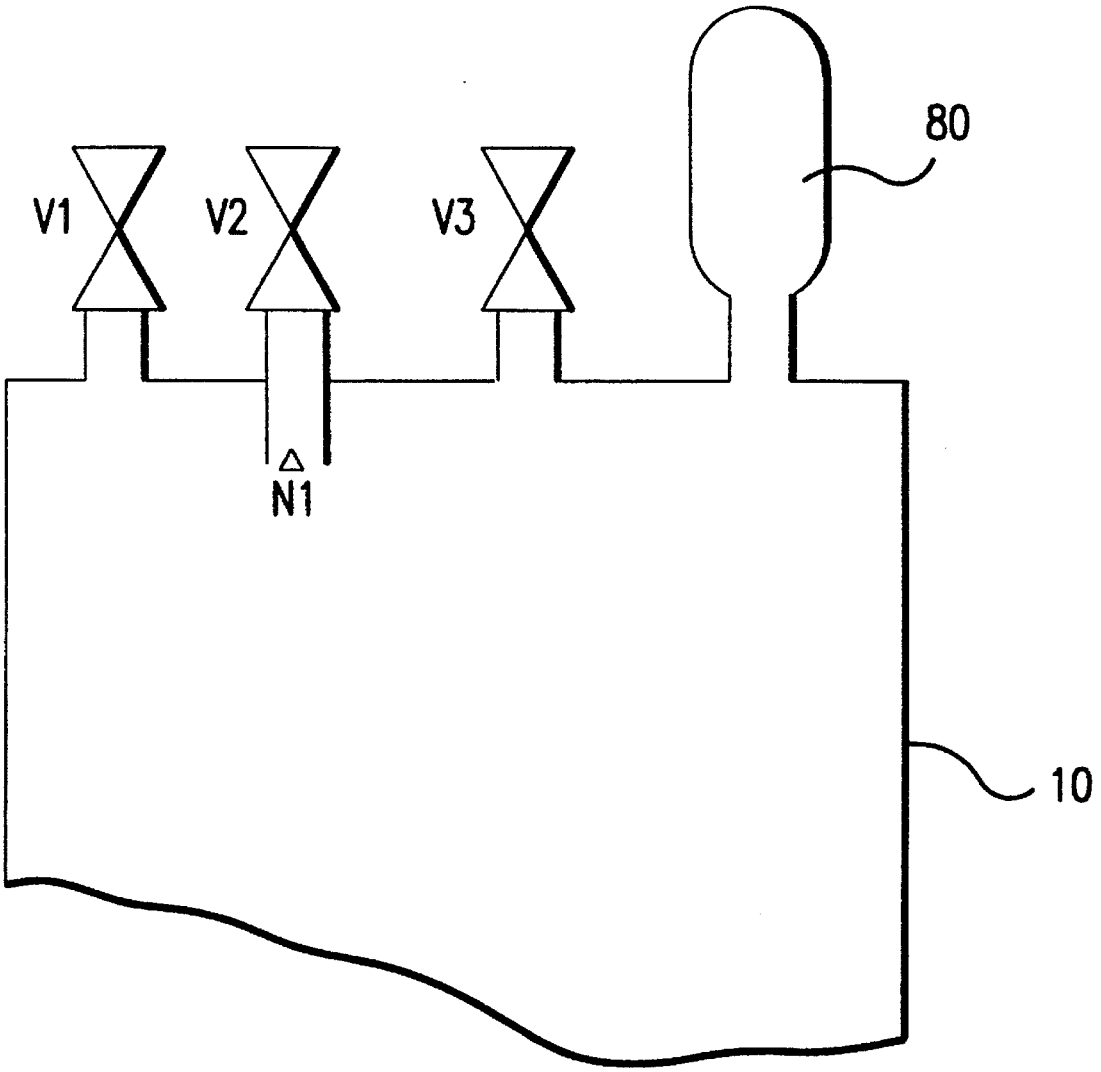
FIG. 6 is a partial schematic view of the liquid spray compressor shown in FIG. 1 with a second vessel.

An arrangement for trapping a small amount of compressed gas in the vessel to accelerate the liquid out of the drain valve V4 is shown in FIG. 6. A vessel 80 is connected to the vessel 10 by piping. During compression, the vessel 80 would be filled with compressed gas. When the drain valve V4 opens the gas in vessel 80 would expand and force the liquid out through the valve V4.

Figure 7:
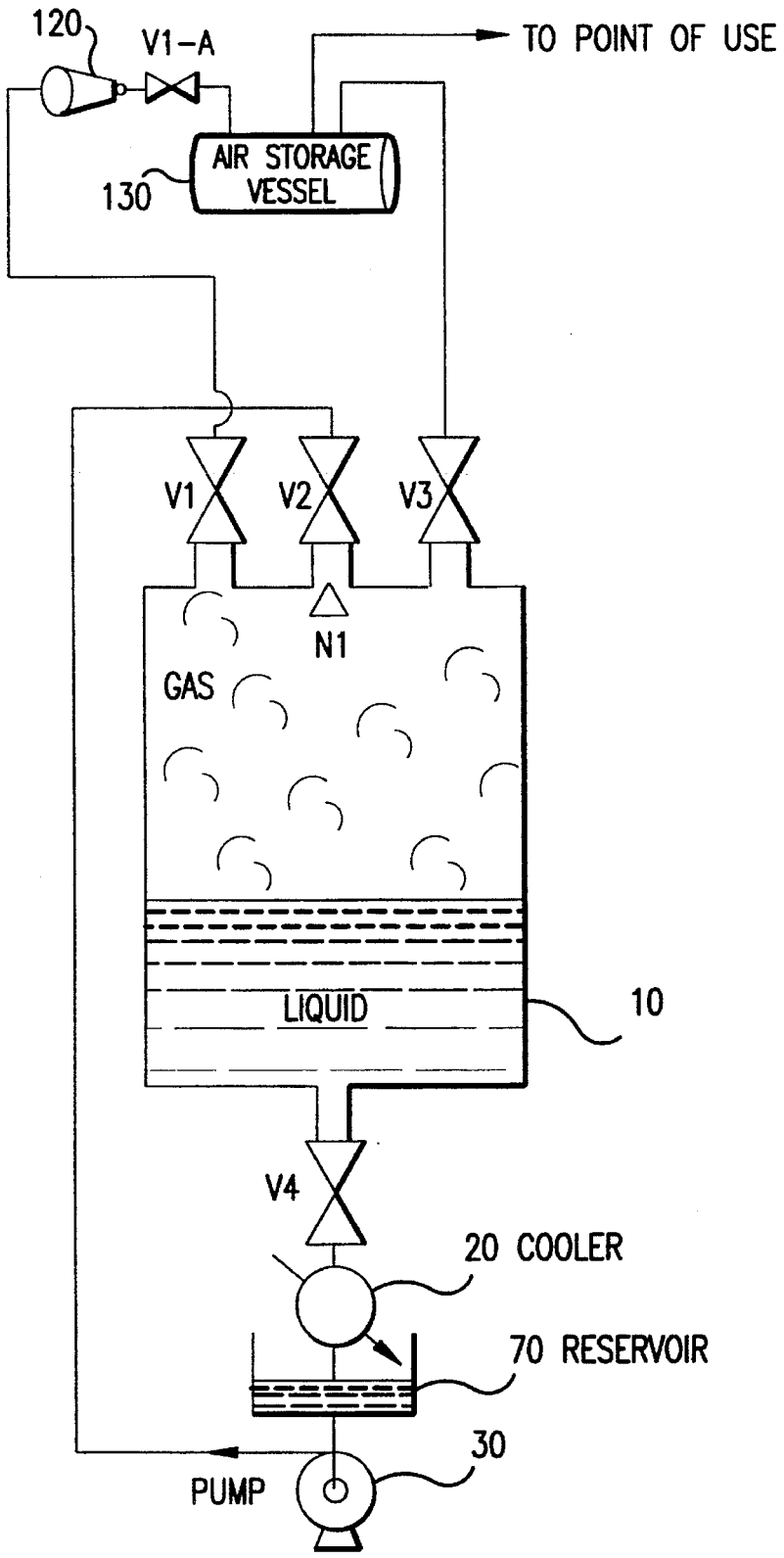
FIG. 7 is a schematic view of the liquid spray compressor shown in FIG. 1 with an additional air storage vessel, air amplifier attached thereto.

FIG. 7 is similar to FIG. 1, but provides a vessel 130 for storage of compressed air. The compressed air is conducted from valve V3 to the vessel 130 by piping. The vessel 130 has two outlet pipes, one conducting compressed air to the point of use, and the other conducting a fraction of the compressed air through the valve V1-A to an air amplifier 120. The valve V1-A is opened and closed at the same times as the valve V1. When valve V1-A is opened, some compressed air flows to the air amplifier 120, inducing a large flow of ambient air through a further pipe or duct, through valve V1 into the compression chamber 10. The draining of liquid is hastened, and the charge of gas to be compressed is of higher initial density.

Figure 8:
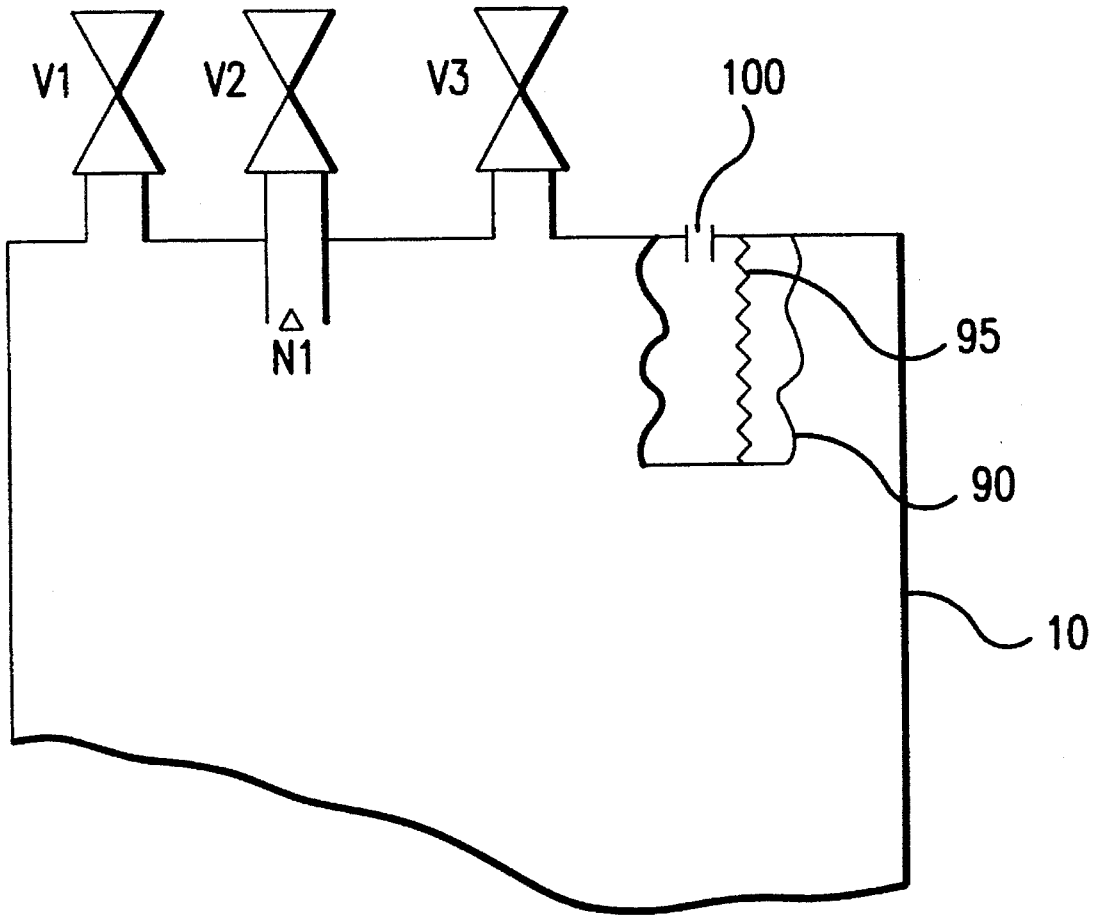
FIG. 8 is a partial schematic view of the liquid spray compressor shown in FIG. 1 having a device to reduce the volume of the cylinder 10.

FIG. 8 illustrates an arrangement for storing mechanical energy in springs, releasing such energy to accelerate liquid out of the drain valve V4. The volume of cylinder 10 is reduced by expanding spring 95, using a bellows 90 as the sealing medium. A vent 100 is provided so gas is not trapped inside the bellows. The sealing medium could alternatively be a flexible diaphragm, or a piston and cylinder. During compression, the pressure on the bellows 90 would compress spring 95. When the drain valve V4 opens, spring 95 would expand exerting pressure on the surrounding fluid, and accelerating the flow of liquid out through valve V4.

Having described several embodiments in accordance with the present invention, it is believed that other modifications, variations and changes will be suggested to those skilled in the art in view of the description set forth above. It is therefor to be understood that all such variations, modifications and changes are believed to fall within the scope of the invention as defined in the appended claims.

What is claimed is:

1. A liquid spray compressor comprising:

a compression vessel having a volume alternately filled with gas and liquid, a liquid drain valve connected to said compression vessel permit liquid to drain from said compression vessel, said liquid drain valve being closed during a compression operation and open during a drain/recharge operation, a cooler disposed down stream from said liquid drain valve for cooling said liquid, a pump drawing suction from said cooler, said pump feeding said liquid to a liquid inlet valve, which allows entry of said liquid to said compression vessel during a compression operation, a dispersion nozzle, disposed between said liquid inlet valve and said compression vessel, said nozzle dispersing said liquid to maximize heat transfer and minimize nozzle back pressure, a feed gas inlet valve to said compression vessel which opens to permit said gas to enter said compression vessel as said liquid is draining out through said liquid drain valve, and a compressed gas outlet valve connected to said compression vessel to allow compressed gas out of said compressed gas valve preventing backflow while said liquid is draining, and being closed until pressure has built up during said compression operation, and preventing passage of said liquid, wherein the speed at which said liquid drains from said compression vessel is increased by one of: means for trapping a small amount of said compressed gas in said compression vessel to accelerate said liquid out of said liquid drain valve; means for storing mechanical energy in elastic elements, and releasing and mechanical energy to accelerate said liquid out said liquid drain valve; boosting pressure and velocity of said feed gas with a mechanical fan; means for boosting velocity of said feed gas with an air amplifier, employing a small stream of said compressed gas; and means for accelerating said compression vessel to create a centrifugal force propelling said liquid out said liquid drain valve.

* * * * *